US010707553B2

(12) United States Patent
Talty et al.

(10) Patent No.: US 10,707,553 B2
(45) Date of Patent: Jul. 7, 2020

(54) CPW-FED MODIFIED SLEEVE MONOPOLE FOR GPS, GLONASS, AND SDARS BANDS

(71) Applicant: GM GLOBAL TECHNOLOGY OPERATIONS LLC, Detroit, MI (US)

(72) Inventors: Timothy J. Talty, Beverly Hills, MI (US); Amit M. Patel, Santa Monica, CA (US); Keerti S. Kona, Woodland Hills, CA (US); Hyok Jae Song, Oak Park, CA (US); James H. Schaffner, Chatsworth, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 118 days.

(21) Appl. No.: 15/583,273

(22) Filed: May 1, 2017

(65) Prior Publication Data

US 2017/0324141 A1 Nov. 9, 2017

Related U.S. Application Data

(60) Provisional application No. 62/332,633, filed on May 6, 2016.

(51) Int. Cl.
*H01Q 9/04* (2006.01)
*H01Q 1/12* (2006.01)
(Continued)

(52) U.S. Cl.
CPC ..... *H01Q 1/1271* (2013.01); *H01Q 1/3291* (2013.01); *H01Q 5/371* (2015.01);
(Continued)

(58) Field of Classification Search
CPC ..... H01Q 1/1271; H01Q 1/48; H01Q 9/0485; H01Q 13/20; H01Q 21/24; H01Q 21/28
See application file for complete search history.

(56) References Cited

U.S. PATENT DOCUMENTS 5,760,744 A * 6/1998 Sauer ..... B32B 17/10036 29/600
7,233,296 B2 6/2007 Song et al.
(Continued)

OTHER PUBLICATIONS

Karamzadeh et al. "Circularly Polarized Square Slot Antenna Using Crooked T-Shape Technique", ACES Journal, vol. 30, No. 3, March 2015 (Year: 2015).*
(Continued)

*Primary Examiner* — Hai V Tran
*Assistant Examiner* — Bamidele A Jegede
(74) *Attorney, Agent, or Firm* — Cantor Colburn LLP

(57) ABSTRACT

A thin film, flexible antenna that has particular application to be adhered to vehicle glass, where the antenna has a wide-band antenna geometry and is operable to receive right-hand or left-hand circularly polarized signals from, for example, GPS and SDARS satellites. The antenna is a printed planar antenna formed to the substrate and includes a ground plane having a slot formed therein and a tuning sleeve having a vertical portion and a horizontal portion. The planar antenna further includes a radiating element positioned adjacent to the tuning sleeve and including a feed portion positioned within the slot, where the radiating element includes a first horizontal portion and a second horizontal portion extending from a vertical portion towards the vertical portion of the sleeve. The ground plane is operable to generate circularly polarized signals to be received by the radiating element where the sleeve provides phase tuning of the signals.

21 Claims, 4 Drawing Sheets

(51) Int. Cl.
*H01Q 1/32* (2006.01)
*H01Q 5/371* (2015.01)

(52) U.S. Cl.
CPC ..... *H01Q 9/045* (2013.01); *H01Q 9/0421* (2013.01); *H01Q 9/0428* (2013.01)

(56) References Cited

U.S. PATENT DOCUMENTS

2003/0034926 A1* 2/2003 Veerasamy ..... H01Q 1/1271 343/713
2005/0052334 A1* 3/2005 Ogino ..... H01Q 1/1271 343/866
2007/0040756 A1* 2/2007 Song ..... H01Q 1/1271 343/713
2009/0128431 A1* 5/2009 Martin ..... B32B 17/10036 343/713
2009/0140938 A1* 6/2009 Ishibashi ..... H01Q 1/1271 343/713
2010/0225554 A1* 9/2010 Huang ..... H01Q 9/16 343/821
2011/0221652 A1* 9/2011 Li ..... H01Q 1/1271 343/860
2012/0154229 A1* 6/2012 Kagaya ..... H01Q 1/1271 343/713
2013/0113664 A1* 5/2013 Kobayashi ..... H01Q 1/1271 343/711
2013/0257664 A1* 10/2013 Kagaya ..... H01Q 1/1271 343/713
2013/0285861 A1* 10/2013 Kagaya ..... H01Q 1/1271 343/712
2014/0015716 A1* 1/2014 Villarroel ..... H01Q 1/1271 343/713
2014/0139399 A1* 5/2014 Miyake ..... H01Q 1/521 343/893
2014/0332519 A1* 11/2014 Sakamoto ..... B60J 1/02 219/203

OTHER PUBLICATIONS

Wang et al. "New CPW-fed monopole antennas with both linear and circular polarisations", IET Microwave Antennas Propagation, 2008, vol. 2, No. 5, pp. 466-472 (Year: 2008).*
Sze, "Design of CPW-Fed Circularly Polarized Slot Antenna With a Miniature Configuration", IEEE Antennas and Wireless Propagation Letters, vol. 10, 2011 (Year: 2011).*
Wang, C. J. et al. "New CPW-Fed Monopole Antennas with Both Linear and Circular Polarisations" IET Microwaves Antennas and Propagation, vol. 2, Issue 5, Sep. 2008, pp. 466-472.

* cited by examiner

CPW-FED MODIFIED SLEEVE MONOPOLE FOR GPS, GLONASS, AND SDARS BANDS

CROSS-REFERENCE TO RELATED APPLICATIONS

This application claims the benefit of the priority date of U.S. Provisional Patent Application Ser. No. 62/332,633, titled, CPW-Fed Modified Sleeve Monopole for GPS, GLONASS, and SDARS Bands, filed May 6, 2016.

BACKGROUND OF THE INVENTION

Field of the Invention

This invention relates generally to a thin film, flexible, wideband antenna configured on a dielectric substrate and, more particularly, to a thin film, flexible, wideband co-planar waveguide (CPW) antenna that may include transparent conductors so as to allow the antenna to be adhered to a visible part of vehicle glass, where the antenna is operable to receive circularly polarized signals for GPS/GNSS or satellite digital audio radio service (SDARS) frequency bands.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. Further, cellular telephone is expanding into 4G long term evolution (LTE) that requires two antennas to provide multiple-input multiple-output (MIMO) signals. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increase, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass typically makes a good dielectric substrate for an antenna. For example, it is known in the art to print AM and FM antennas on the glass of a vehicle where the printed antennas are fabricated within the glass as a single piece. However, these known antennas are generally limited in that they can only be placed in a vehicle windshield or other glass surface in areas where viewing through the glass is not necessary.

For those antennas that receive satellite signals, such as GPS, SDARS, GLONASS, satellite radio, etc., the transmitted signals are left-hand or right-hand circularly polarized because the ionosphere acts to rotate the transmitted signal, which would otherwise affect linearly polarized signals. Thus, there is a need for a suitable antenna capable of being mounted on vehicle glass and being applicable to receive right-hand or left-hand circularly polarized signals.

SUMMARY OF THE INVENTION

The present invention discloses and describes a thin film, flexible antenna that has particular application to be adhered to a dielectric substrate on a vehicle, such as a vehicle glass, where the antenna has a wideband antenna geometry and is operable to receive right-hand or left-hand circularly polarized signals from, for example, GPS and SDARS satellites. The antenna is a printed planar antenna formed to the substrate and includes a ground plane having a slot formed therein and a tuning sleeve having a vertical portion and a horizontal portion. The planar antenna further includes a radiating element positioned adjacent to the tuning sleeve and including a feed portion positioned within the slot, where the radiating element includes a first horizontal portion and a second horizontal portion extending from a vertical portion towards the vertical portion of the sleeve. The ground plane is operable to generate circularly polarized signals to be received by the radiating element where the sleeve provides phase tuning of the signals.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a thin film, flexible wideband antenna suitable to be adhered to a curved dielectric structure is merely exemplary in nature, and is in no way intended to limit the invention or its applications or uses. For example, the discussion herein talks about the antenna being applicable to be adhered to automotive glass. However, as will be appreciated by those skilled in the art, the antenna will have application for other dielectric structures other than automotive structures and other than transparent or translucent surfaces.

Figure 1:
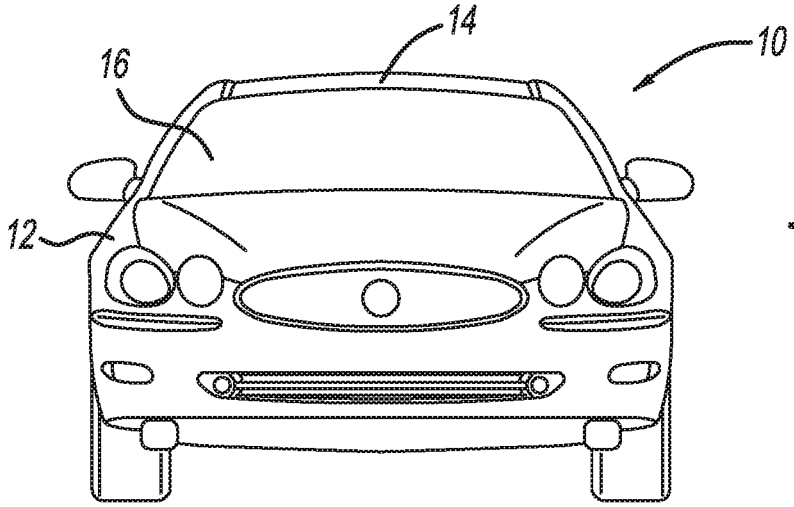
FIG. 1 is front view of a vehicle showing a vehicle windshield.
Figure 2:
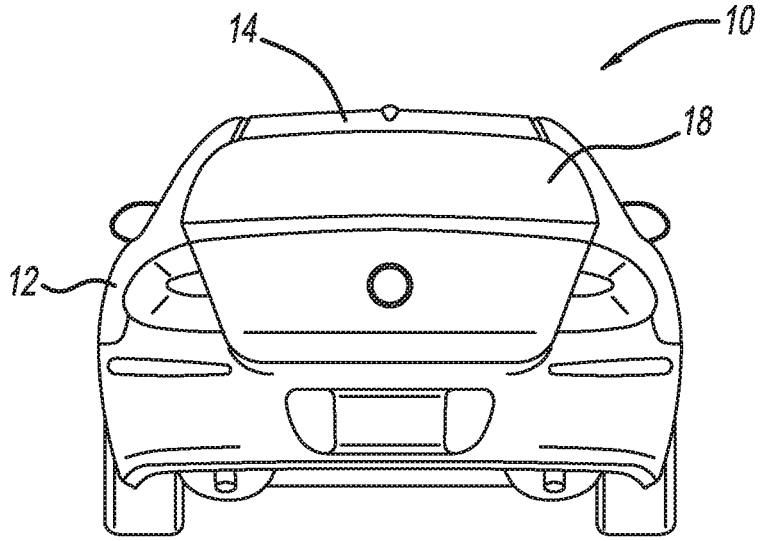
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18.

As will be discussed in detail below, the present invention proposes providing a thin film, flexible, wideband CPW antenna structure mountable on the windshield 16, the rear window 18, or any other window or dielectric substrate on the vehicle 10, where the antenna structure is flexible to conform to the shape of the particular dielectric structure, and where the antenna structure can be mounted at any suitable location on the dielectric structure, including locations on the windshield 16 that the vehicle driver needs to see through. The antenna structure has particular application for receiving circularly polarized signals, such as GPS and SDARS signals. In one embodiment, the antenna structure is a wideband monopole appliqué antenna that is installed directly on the surface of the dielectric structure by a suitable adhesive. The antenna structure can be designed to operate on automotive glass of various physical thicknesses and dielectric properties, where the antenna structure operates as intended when installed on the glass or other dielectric since in the design process the glass or other dielectric is considered in the antenna geometry pattern development.

Figure 3:
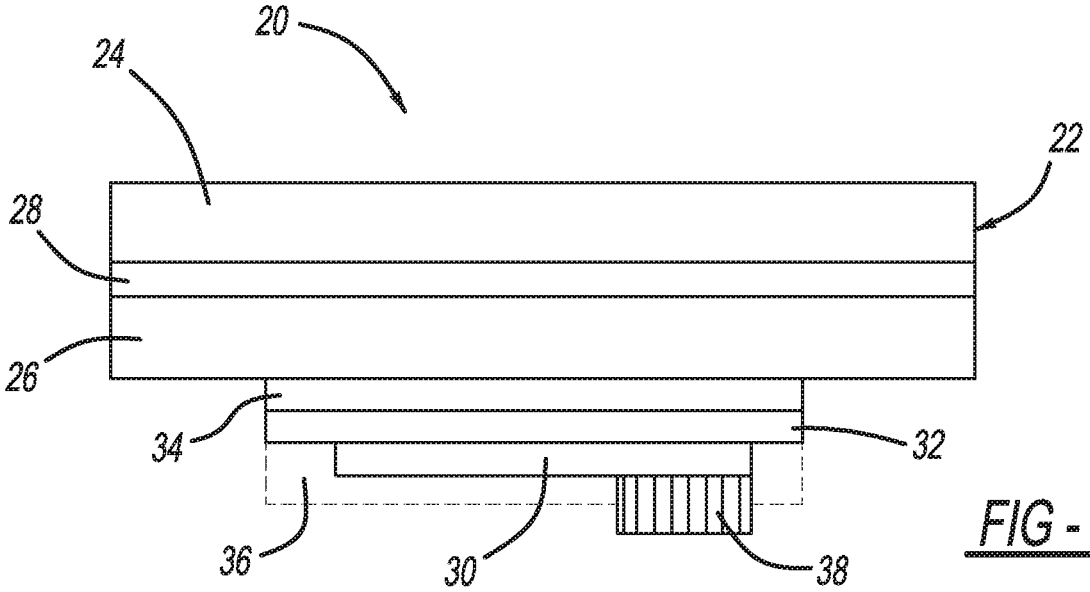
FIG. 3 is a profile view of a vehicle window including a thin, flexible antenna formed thereon.

FIG. 3 is a profile view of an antenna structure 20 including a windshield 22 having an outer glass layer 24, an inner glass layer 26 and a polyvinyl butyral (PVB) layer 28 therebetween. The structure 20 includes an antenna 30 formed on a thin, flexible film substrate 32, such as polyethylene terephthalate (PET), biaxially-oriented polyethylene terephthalate (BoPET), mylar, flexible glass substrates, Kapton, etc., and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector such as a direct pig-tail or coaxial cable connection. Although the antenna 30 is shown being coupled to an inside surface of the inner glass layer 26, the conductor 30 can be adhered to the outer surface of the outer glass layer 24 or the surface of the layers 24 or 26 adjacent to the PVB layer 28 or the surfaces of the PVB layer 28.

The antenna 30 can be formed by any suitable low loss conductor, such as copper, gold, silver, silver ceramic, metal grid/mesh, etc. If the antenna 30 is at a location on the vehicle glass that requires the driver or other vehicle occupant to see through the glass, then the antenna conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary approximately over 2.8 mm-5 mm and have a relative dielectric constant $\varepsilon_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass, a backing layer of the transfer tape can be removed. By providing the antenna conductor on the inside surface of the vehicle windshield 22, degradation of the antenna 30 can be reduced from environmental and weather conditions.

As discussed above, it is desirable to provide antennas on vehicles that are transparent and can be integrated in a conformal manner to the curved windshield or vehicle glass. The present invention discloses an antenna structure that is operable to receive signals in the GPS or SDARS frequency bands with appropriate polarization when mounted or integrated on the vehicle glass. The antenna structure is shaped and patterned into a transparent conductor and a co-planar structure where both the antenna and ground conductors are printed on the same layer. The antenna can use low cost thin films made of transparent conductive oxides and silver nano-wires with a high conductivity metal frame surrounding the antenna elements.

Figure 4:
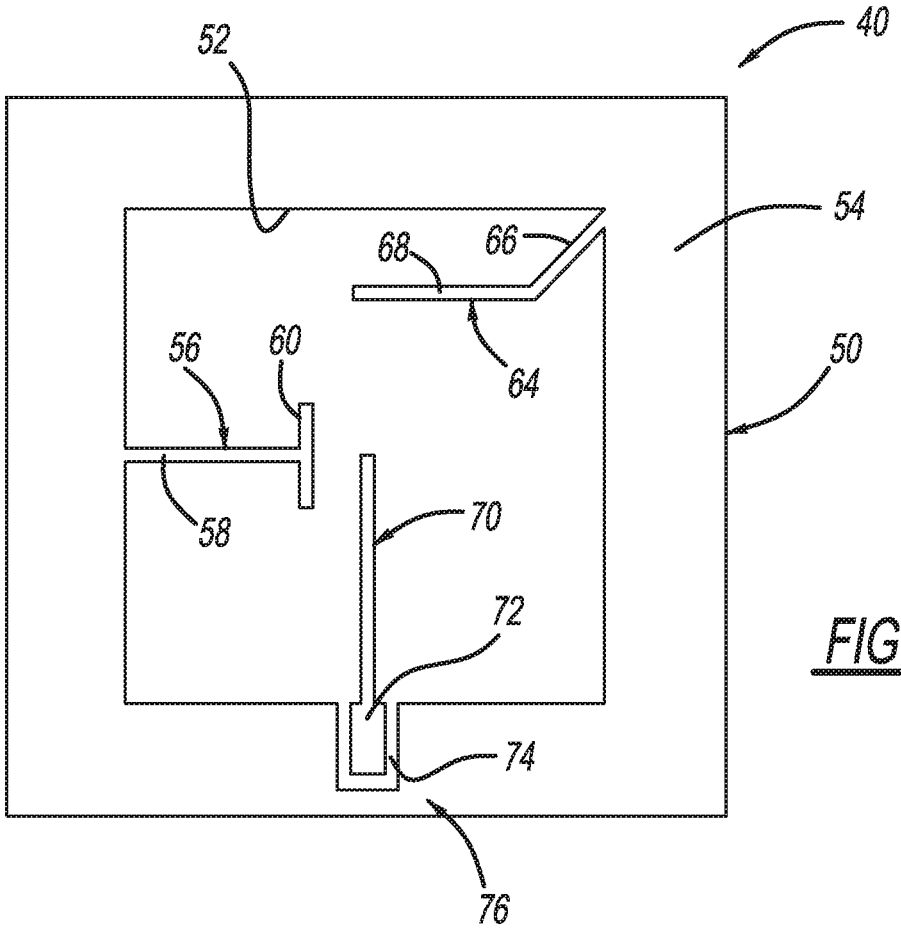
FIG. 4 is a top view of an antenna structure including a CPW antenna structure being operable to receive right-hand circularly polarized GPS signals.
Figure 5:
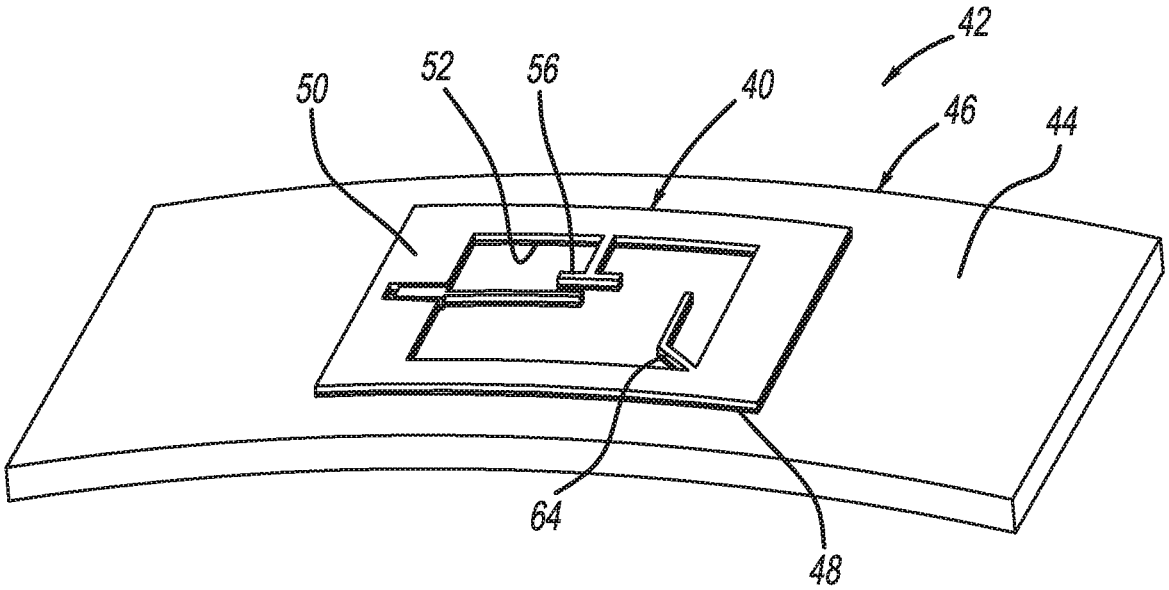
FIG. 5 is an isometric view of the antenna structure shown in FIG. 4 being mounted to a curved vehicle glass.

In one embodiment, the antenna structure is a variation of a CPW fed square slot antenna with a T-line and spur-line to produce circularly polarized signals adapted for a curved surface of a vehicle glass. FIG. 4 is a top view of an antenna structure 40 that has application to operate in the GPS frequency band to receive right-hand circularly polarized signals and is of the type discussed herein that can be secured to vehicle glass. For example, FIG. 5 is an isometric illustration 42 of the antenna structure 40 secured to a surface 44 of a curved vehicle glass 46 by an adhesive layer 48. The antenna structure 40 includes a conductive ground plane 50 having a square outer perimeter portion 54 defining a square slot 52 therein that is patterned along with other conductive portions of the antenna structure 40 on a suitable substrate (not shown), such as mylar. The ground plane 50 includes a T-line tuning stub 56 extending into the slot 52 from one side of the perimeter portion 54, where the stub 56 includes a line portion 58 and a T-end 60. The ground plane 50 also includes a spur-line tuning stub 64 electrically coupled to one of the corners of the perimeter portion 54 and extending into the slot 52, where the tuning stub 64 includes an angled portion 66 and a straight portion 68. An antenna radiating element 70 also extends into the slot 52 and ends at a central part of the slot 52 proximate the T-end 60 of the T-line tuning stub 56. The element 70 includes a feed line portion 72 that is positioned within a gap 74 in the perimeter portion 54 and is electrically isolated therefrom, where the feed line portion 72 is part of a CPW feed structure 76.

When the antenna structure 40 receives GPS signals, currents are generated in the perimeter portion 54 and propagate around the slot 52. The tuning stubs 56 and 58 receive those currents and reflect them back into the perimeter portion 54, which changes the phase of the signals. The circular polarization is provided by a 90° phase difference between the currents propagating in perpendicular sections of the perimeter portion 54. The T-line tuning stub 56 provides coupling of the currents from the perimeter portion 54 to the radiating element 60. The length of the tuning stubs 56 and 64, the angle that the tuning stub 64 extends from the perimeter portion 54, etc., are all selectively optimized for the particular frequency band of interest. In this embodiment, the GPS signals are right-hand circularly polarized signals, and thus the currents propagate in a counter-clockwise direction. The T-line tuning stub 56 and the spur-line tuning stub 64 have different geometries and angles resulting in an improved impedance bandwidth of ~30%, a 3-db axial ratio bandwidth of ~16.3%, gain of 3 dBic, and an axial ratio beamwidth at the center frequency stretching over a range greater than +−45° for the GPS signals center at 1.575 GHz.

Figure 6:
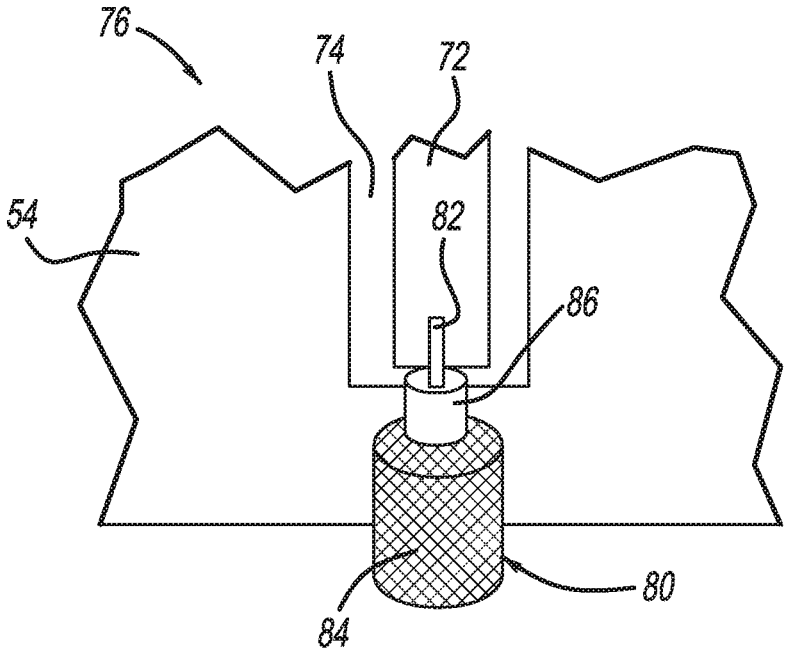
FIG. 6 is an illustration of a CPW antenna feed structure including a coaxial cable feed line for the antenna structure shown in FIG. 4.

Any suitable feed structure can be employed for feeding the antenna element 70. FIG. 6 is top, cut-away view of the CPW antenna feed structure 76 showing one suitable example. In this embodiment, a coaxial cable 80 provides the incoming signal line for the feed structure 76 and includes an inner conductor 82 electrically coupled to the feed line portion 72 and an outer ground conductor 84 electrically coupled to the perimeter portion 54, where the conductors 82 and 84 are separated by an insulator 86.

Figure 7:
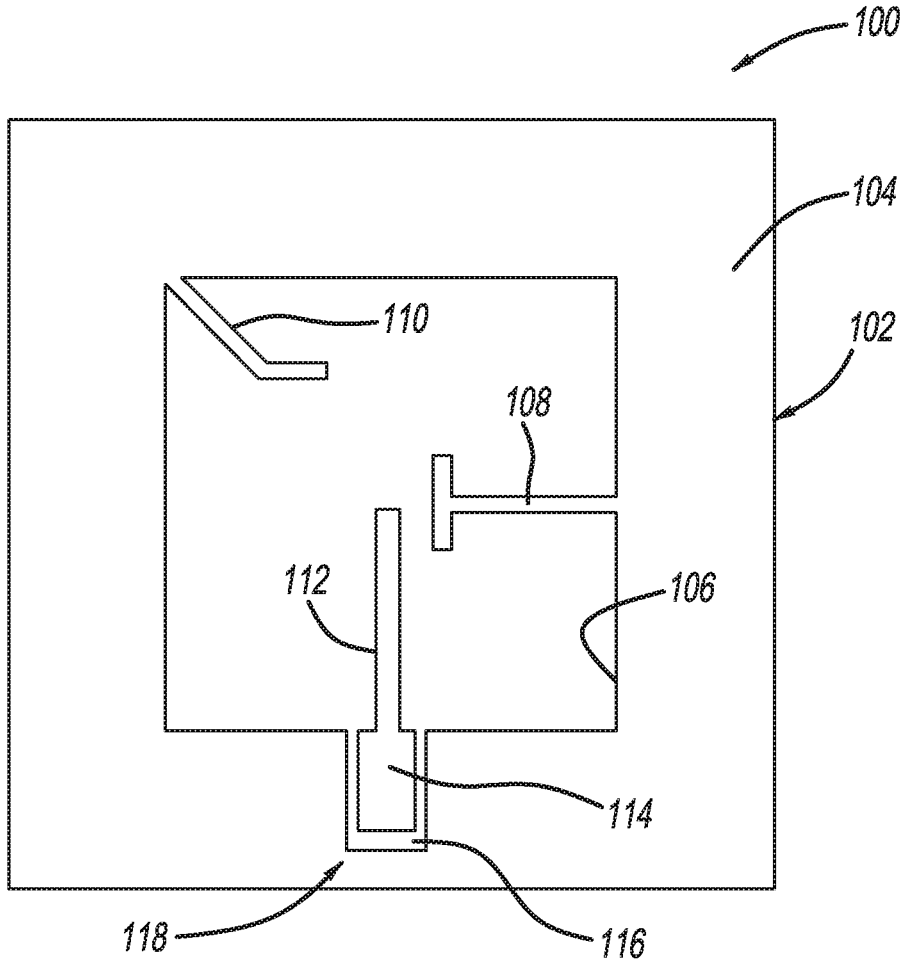
FIG. 7 is a top view of an antenna structure including a CPW antenna structure being operable to receive left-hand circularly polarized SDARS signals.

FIG. 7 is a top view of an antenna structure 100 that has application to operate in the SDARS frequency band to receive left-hand circular polarized signals and is the type discussed herein that can be secured to vehicle glass. The antenna structure 100 has a similar configuration to the antenna structure 40 where it includes a conductive ground plane 102 having a square outer perimeter portion 104 defining a square slot 106 therein. The ground plane 102 includes a T-line tuning stub 108 and a spur-line tuning stub 110, where the tuning stub 110 is on opposite side of the perimeter portion 104 than the tuning the stub 56 and the spur-line tuning stub 110 is at an opposite corner than the tuning stub 64, as shown, for the right-hand circularly polarized signals. The antenna structure 100 also includes an antenna radiating element 112 having a feed line portion 114 positioned within a gap 116 that is part of a feed structure 118. For the embodiment for SDARS signals, which in North America includes Sirius™ and XM™ in the frequency band 2320-2345 MHz, the T-line tuning stub 110 and the spur-line tuning stub 112 have different geometries and angles resulting in improved impedance bandwidth of ~39%, a 3-db axial ratio bandwidth of ~20%, gain of 3 dBic, and an axial ratio beamwidth at the center frequency stretching over a range greater than +–45°.

The embodiments discussed above for the co-planar circularly polarized antenna structures provides the advantages discussed, and can be positioned on the vehicle glass near a metal structure, such as a vehicle roof, because the outer perimeter portions 54 and 104 operate as a frequency selective surface that prevents surface waves from radiating outward therefrom in a manner understood by those skilled in the art. However, these designs do take up some real-estate and have additional copper patterning that is required for the ground plane. If conductive surfaces close to the antenna are not an issue, then other co-planar circularly polarized antenna structures can be provided that require less area and less ground metal. For example, another embodiment includes a co-planar waveguide sleeve monopole antenna structure that also has application to receive GPS and SDARS circularly polarized signals.

Figure 8:
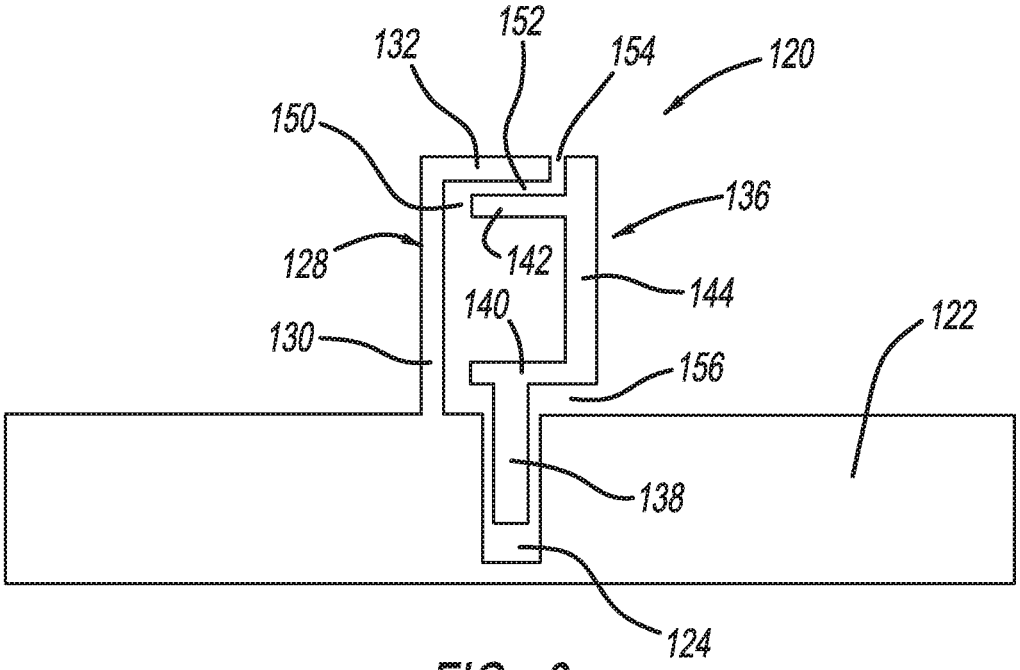
FIG. 8 is a top view of an antenna structure including a CPW antenna structure being operable to receive right-hand circularly polarized GPS signals.

FIG. 8 is a top view of an antenna structure 120 that also operates in the GPS frequency band, but in this embodiment is operable to receive right-hand circularly polarized signals, where the antenna structure 120 is a thin film, flexible co-planar slot type antenna of the type discussed herein that includes patterned conductors printed on a thin flexible substrate. The antenna structure 120 includes a conductive ground plane 122 having a slot 124 formed therein and an inverted-L tuning sleeve 128 having a vertical portion 130 and a horizontal portion 132 coupled as part of the ground plane 122. A conductive monopole radiating element 136 is positioned adjacent to the tuning sleeve 128, but is electrically isolated therefrom and includes a feed portion 138 positioned within the slot 124. Any suitable feed structure can be provided to feed the radiating element 136, such as the feed structure 76 shown in FIG. 6. The radiating element 136 includes a first horizontal portion 140 and a second horizontal portion 142 extending from a vertical portion 144 towards the vertical portion 130 of the sleeve 128, as shown. When the antenna structure 120 receives the GPS signals, currents are generated in the orthogonal portions 130 and 132 of the sleeve 128 and the radiating element 136 in both a horizontal and vertical direction that are orthogonal to each other to generate the right-hand circularly polarized signals.

For GPS signals in the frequency band 1574.4-1576.4 MHz, the ground plane 122 can have a length of 80 mm and a width of 13.6 mm, the vertical portion 130 can have a length of 20 mm and the combined length of the horizontal portion 132 and the width of the vertical portion 144 can be 14 mm. Further, a gap 150 between the vertical portion 130 and the horizontal portion 142 can be 1.9167 mm, a gap 152 between the horizontal portion 132 and the horizontal portion 142 can be 0.8379 mm, a gap between the horizontal portion 132 and the vertical portion 144 can be 0.9080 mm, and a gap 156 between the horizontal portion 140 and the ground plane 122 can be 1.9774 mm.

Figure 9:
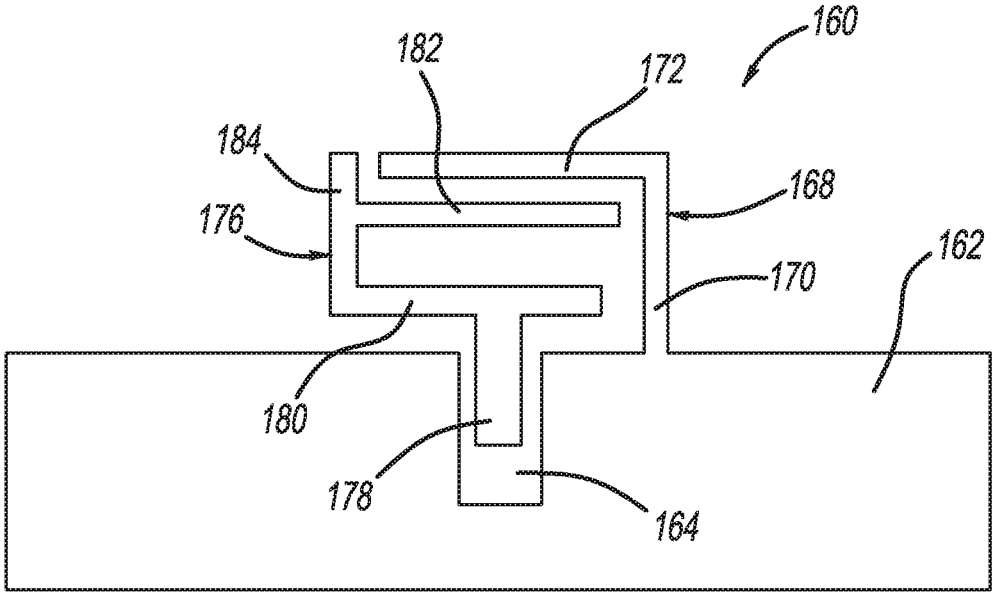
FIG. 9 is a top view of an antenna structure including a CPW antenna structure being operable to receive left-hand circularly polarized SDARS signals.

FIG. 9 is a top view of an antenna structure 160 that also operates in the SDARS frequency band, but in this embodiment is operable to receive left-hand circularly polarized signals, where the antenna structure 160 is a thin film, flexible co-planar slot type antenna of the type discussed herein that includes patterned conductors printed on a thin flexible substrate. The antenna structure 160 is similar to the antenna structure 120, but is oriented to receive left-hand circularly polarized signals and has dimensions for the SDARS frequency band. The antenna structure 160 includes a conductive ground plane 162 having a slot 164 formed therein and an inverted-L tuning sleeve 168 having a vertical portion 170 and a horizontal portion 172 coupled as part of the ground plane 162. A conductive monopole radiating element 176 is positioned adjacent to the tuning sleeve 168, but is electrically isolated therefrom, and includes a feed portion 178 positioned within the slot 164. The radiating element 176 includes a first horizontal portion 180 and a second horizontal portion 182 extending from a vertical portion 184 towards the vertical portion 170 of the sleeve 168, as shown. When the antenna structure 160 receives the SDARS signals, currents are generated in the orthogonal portions 170 and 172 of the sleeve 168 and the radiating element 176 in both a horizontal and vertical direction to generate the left-hand circularly polarized signals.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna structure comprising:

a dielectric structure;

a thin film substrate adhered to the dielectric structure by an adhesive layer, the dielectric structure having an outer layer and an inner layer, the thin film substrate adhered to the inner layer; and a planar antenna formed to the substrate opposite to the adhesive layer, said planar antenna including a conductive ground plane having a continuous outer perimeter portion with a partial slot formed therein, and a tuning sleeve having a vertical portion and a horizontal portion, said planar antenna further including a radiating element positioned adjacent to the tuning sleeve and including a feed portion positioned within the partial slot, said radiating element further including a first horizontal portion and a second horizontal portion extending from a vertical portion towards the vertical portion of the sleeve, said ground plane surrounding the radiating element and being operable to generate circularly polarized signals to be received by the radiating element where the sleeve provides phase tuning of the signals;

wherein the dielectric structure having an outer layer and an inner layer with a polyvinyl butyral (PVB) layer between the inner layer and the outer layer, the thin film substrate adhered to the inner layer, and wherein the thin film substrate adhered to an interior surface of the inner layer of the dielectric structure.

2. The antenna structure according to claim 1 wherein the tuning sleeve is configured to provide phase tuning for right-hand circularly polarized signals.

3. The antenna structure according to claim 2 wherein the right-hand circularly polarized signals are GPS signals.

4. The antenna structure according to claim 1 wherein the tuning sleeve is configured to provide phase tuning for left-hand circularly polarized signals.

5. The antenna structure according to claim 4 wherein the left-hand circularly polarized signals are satellite digital audio radio service (SOARS) signals.

6. The antenna structure according to claim 1 further comprising a feed structure being electrically coupled to the ground plane and the antenna element.

7. The antenna structure according to claim 6 wherein the feed structure is a co-planar waveguide feed structure.

8. The antenna structure according to claim 7 further comprising a coaxial connector connected to the co-planar waveguide feed structure.

9. The antenna structure according to claim 1 wherein the dielectric structure is at least one of a vehicle window and a vehicle windshield.

10. The antenna structure according to claim 1 wherein the thin film substrate, adhesive layer and a planar antenna are formed and an adhesive applique, wherein the applique may be adhered to the dielectric structure after the fabrication of the dielectric structure.

11. The antenna structure according to claim 1 wherein the planar antenna includes transparent conductors.

12. The antenna structure according to claim 1 wherein the thin film substrate is selected from the group consisting of mylar, Kapton, PET and flexible glass substrates.

13. An antenna structure comprising:

a dielectric structure;

a thin film substrate adhered to the dielectric structure by an adhesive layer, the dielectric structure having an outer layer and an inner layer, the thin film substrate adhered to the inner layer;

a planar antenna formed to the substrate opposite to the adhesive layer, said planar antenna including a conductive ground plane portion having a continuous outer perimeter portion with a partial slot formed therein, an L-shaped tuning sleeve extending from the ground plane portion and being electrically coupled thereto, said L-shaped tuning sleeve including a vertical portion and a horizontal portion, and a C-shaped monopole portion including a feed portion positioned within the slot, a vertical portion, a first horizontal portion extending from the vertical portion towards the horizontal portion of the L-shaped tuning sleeve and a second horizontal portion extending from the vertical portion towards the horizontal portion of the L-shape tuning sleeve;

wherein the dielectric structure having an outer layer and an inner layer with a polyvinyl butyral (PVB) layer between the inner layer and the outer layer, the thin film substrate adhered to the inner layer, and wherein the thin film substrate adhered to an interior surface of the inner layer of the dielectric structure.

14. The antenna structure according to claim 13 wherein the tuning sleeve is configured to provide phase tuning for right-hand circularly polarized signals.

15. The antenna structure according to claim 14 wherein the right-hand circularly polarized signals are GPS signals.

16. The antenna structure according to claim 13 wherein the tuning sleeve is configured to provide phase tuning for left-hand circularly polarized signals.

17. The antenna structure according to claim 16 wherein the left-hand circularly polarized signals are satellite digital audio radio service (SOARS) signals.

18. An antenna structure comprising: a vehicle window;

a thin film substrate adhered to the vehicle window by an adhesive layer, the vehicle window having an outer layer and an inner layer, the thin film substrate adhered to the inner layer; and a planar antenna formed to the substrate opposite to the adhesive layer, said planar antenna including a ground plane having a continuous outer perimeter portion with a partial slot formed therein, and a tuning sleeve having a vertical portion and a horizontal portion, said planar antenna further including a radiating element positioned adjacent to the tuning sleeve and including a feed portion positioned within the slot, said radiating element further including a first horizontal portion and a second horizontal portion extending from a vertical portion towards the vertical portion of the sleeve, said ground plane being operable to generate circularly polarized signals to be received by the radiating element where the sleeve provides phase tuning of the signals, wherein the tuning sleeve is configured to provide phase tuning for right-hand circularly polarized GPS signals or left-hand circularly polarized satellite digital audio radio service (SOARS) signals;

wherein the dielectric structure having an outer layer and an inner layer with a polyvinyl butyral (PVB) layer between the inner layer and the outer layer, the thin film substrate adhered to the inner layer, and wherein the thin film substrate adhered to an interior surface of the inner layer of the dielectric structure.

19. The antenna structure according to claim 18 wherein the vehicle window is a windshield.

20. The antenna structure according to claim 18 wherein the planar antenna includes transparent conductors.

21. An antenna structure comprising: a dielectric structure;

a thin film substrate adhered to the dielectric structure by an adhesive layer, the dielectric structure having an outer layer and an inner layer, the thin film substrate adhered to the inner layer; and a planar antenna formed to the substrate opposite to the adhesive layer, said planar antenna including a conductive ground plane having a continuous outer perimeter portion with a partial slot formed therein, and a tuning sleeve having a vertical portion and a horizontal portion, said planar antenna further including a radiating element positioned adjacent to the tuning sleeve and including a feed portion positioned within the partial slot, said radiating element further including a first horizontal portion and a second horizontal portion extending from a vertical portion towards the vertical portion of the sleeve, said ground plane being operable to generate circularly polarized signals to be received by the radiating element where the sleeve provides phase tuning of the signals;

wherein the dielectric structure having an outer layer and an inner layer with a polyvinyl butyral (PVB) layer between the inner layer and the outer layer, the thin film substrate adhered to the inner layer, and wherein the thin film substrate adhered to an interior surface of the inner layer of the dielectric structure.

* * * * *